US005264339A

United States Patent [19]

Tavernier et al.

[11] Patent Number: 5,264,339

[45] Date of Patent: Nov. 23, 1993

[54] METHOD FOR THE MAUFACTURE OF A RECORDING MATERIAL INCLUDING GELATIN

[75] Inventors: Bernard H. Tavernier, Edegem; Frank P. Michiels, Arendonk, both of Belgium

[73] Assignee: Agfa-Gevaert N.V., Mortsel, Belgium

[21] Appl. No.: 941,265

[22] Filed: Sep. 4, 1992

[30] Foreign Application Priority Data

Sep. 12, 1991 [EP] European Pat. Off. ..... 91202334.8

[51] Int. Cl.[5] ..... G03C 1/30

[52] U.S. Cl. ..... 430/621; 430/510; 430/539; 430/642; 430/935; 427/420

[58] Field of Search ..... 427/420; 430/510, 539, 430/621, 642, 935

[56] References Cited

U.S. PATENT DOCUMENTS 4,944,966 7/1990 Jerenz ..... 430/642

*Primary Examiner*—Jack P. Brammer

[57] ABSTRACT

In a method for the manufacture of a recording material containing a coated and dried gelatin containing layer on a support, the improvement wherein such layer is coated from an aqueous coating composition containing:

(1) hydrophilic colloid matter consisting of at least 90% by weight of gelatin, (2) not more than 5% by weight with respect to the total gelatin content of a thickening agent increasing the viscosity of said composition, and (3) a hardening agent for gelatin that reduces its water-solubility after coating, characterized in that said gelatin is a gelatin species which as a 10% by weight aqueous solution at 36° C. and pH 6 has a viscosity of at least 35 Mpa.s at a shear rate of 1000 $S^{-1}$ and shows a decrease in viscosity by at least 10 Mpa.s at a shear rate of 40,000 $s^{-1}$, and as a 3% by weight aqueous solution at Ph 6 and after cooling for 30 seconds at a shearing rate of 208 $s^{-1}$ has a solidification time of less than 20 seconds and a consistency characteristic corresponding with a viscosity of more than 500 Mpa.s determined under the test conditions of Test S described in the specification.

10 Claims, 2 Drawing Sheets

METHOD FOR THE MAUFACTURE OF A RECORDING MATERIAL INCLUDING GELATIN

FIELD OF THE INVENTION

The present invention relates to the manufacture of recording materials, especially silver halide emulsion layer materials including the use of a particular gelatin species.

BACKGROUND OF THE INVENTION

In photographic silver halide emulsion layers gelatin remains the principal binder employed in the art.

The demand for rapid processing, dimensional stability, and image sharpness has led to a steady decrease in gelatin-AgX ratios to give thinner emulsion layers, e.g. 10 micron thick for colour reversal emulsions and 5 micron thick for rapid access medical X-ray films (ref. SPSE Handbook of Photographic Science and Engineering—Woodlief Thomas, Jr. Editor, SPSE—A Wiley Interscience Publication—John Wiley & Sons, New York, (1973), p. 514).

From the book "Photographic Chemistry" by Pierre Glafkidés, Vol. I, (1958), p. 314–315 it is known that a silver halide emulsion containing little gelatin with respect to the silver halide will develop more rapidly, and that the gamma infinity will be reached more quickly.

A decrease in the amount of gelatin and the reduction of the coating thickness brings about a series of problems of which coating uneveness and coating streaks are the most important.

In coating a gelatin containing layer the viscosity of the coating liquid is of particular importance in the choice of the coating technique. Modern coating apparatus used for high speed coating of gelatin containing aqueous coating liquids on web type film or paper supports are the slide hopper coater and the curtain coater. Examples of curtain coaters are described in U.S. Pat. Nos. 3,632,374, 3,867,901 and examples of slide hopper coaters are described in U.S. Pat. Nos. 2,761,791, 4,113,903 and published EP-A 0 382 058.

When carrying out a method operating with high coating speed it is of utmost importance that after coating the gelatin containing layer on cooling sets or solidifies as rapidly as possible and its consistency reaches rapidly a degree allowing the drying, i.e. the removal of water from the coated layer, with a vigorous dry air current without distorting the already solidified layer containing gelatin in gel form. Only by combining rapid coating speed with short solidification and drying stages can the production speed of recording materials based on (a) gelatin containing coating(s) be increased substantially.

It is known that silver halide emulsions with very low viscosities are more prone to instability in the coating bead before contact with the web, which causes coating defects, and undesired interlayer mixing in multilayer coating. Various thickening agents have been proposed to facilitate the coating of dilute photographic emulsions as described e.g. in U.S. Pat. No. 3,767,410. Many of these agents are not entirely satisfactory and they exhibit problems such as the production of haze, brittleness, and for anionic macromolecular polyelectrolytes restricted use in a particular pH environment because of undesired coagulation of the gelatin in their presence.

As a practical matter, e.g. with the objective of manufacturing low gelatin-content photograph gelatin silver halide emulsion layer materials, it is therefore preferred to eliminate any thickening agents and still to obtain a desired viscosity in the gelatin containing coating liquids correlated with a proper shear rate for fault-free coating.

The use of thickening agents, more particularly anionic macromolecular polyelectrolytes, with the aim to obtain gelatin solutions having strong shear rate dependency is in many cases unfavorable for rapid solidification of the coated layer.

The coating of low gelatin-content silver halide emulsion layers is particularly important when ultra rapid processing is sought by which is meant processing within 20 to 60 seconds in total time during which the development, fixing, water rinsing and drying of a given point on the photographic material is completed.

Ultra-rapid processing proceeds normally at elevated temperature, e.g. in the temperature range of 30° to 45° C. in automatic roller transport apparatus. Under such conditions low gelatin content silver halide emulsion layers have too low an abrasion resistance, may show roller marks and give rise to sludge formation.

OBJECTS AND SUMMARY OF THE INVENTION

It is a general object of the present invention to use in the manufacture of recording materials an aqueous gelatin containing coating compositions that can be coated at high coating speed followed by rapid solidification on cooling.

It is more particularly an object of the present invention to use in the coating of a photosensitive gelatin containing silver emulsion a type or species of gelatin of which an aqueous solution can be coated at high speed followed by rapid solidification on cooling whereby drying of the silver halide emulsion layer can start already very soon after coating.

It is another object of the present invention to use said type of gelatin in the manufacture of a photographic gelatin-silver emulsion material wherein the gelatin containing layer(s) contain(s) little or no thickening agent added to the gelatin and the gelatin has still good binding capacity for the dispersed silver halide grains of the emulsion layer.

It is a particular object of the present invention to provide a photographic silver halide emulsion material which comprises at least one photosensitive gelatin-silver halide emulsion layer containing said type of gelatin in a fairly low weight ratio of gelatin to silver halide (called hereinafter GESI), wherein for the coating of said layer, e.g. by means of slide hopper or curtain coater operating at relatively high coating speed followed by rapid solidification of the coated layer, little or no thickening agent for said gelatin has been used.

Other objects and advantages of the present invention will appear from the further description and examples.

In accordance with the present invention a method for the manufacture of a recording material containing a coated and dried gelatin-containing layer on a support is provided, wherein the coating of said layer proceeds by applying onto said support an aqueous coating composition containing :

(1) hydrophilic colloid matter consisting for at least 90 % by weight of gelatin, (2) no thickening agent(s) increasing the viscosity of said composition or containing no more than 5 % by weight of such thickening agent(s) with respect to the total gelatin content of said composition, (3) a hardening agent of gelatin that reduces its water-solubility after coating, characterized in that said gelatin is a gelatin species which as a 10% by weight aqueous solution at 36° C. and pH 6 has a viscosity of at least 35 mPa.s at a shearing rate of 1000 $s^{-1}$ and shows a decrease in viscosity by at least 10 mPa.s at a shear rate of 40,000 $s^{-1}$, and said gelatin species has a solidification time of less than 20 seconds and consistency characteristic corresponding with a viscosity of more than 500 mPa.s determined on a 3% wt solution of said gelatin in water at pH=6 after cooling for 30 seconds at a shearing rate of 208 $s^{-1}$ proceeding under the test conditions of Test S described herein.

Further in accordance with the present invention a photographic gelatin-silver halide emulsion layer material is provided comprising a support having thereon at least one layer containing hardened gelatin, wherein said layer has been coated on said support from an aqueous gelatin-containing coating composition as defined above and dried on said support.

SHORT DESCRIPTION OF THE DRAWINGS

FIG. 1 contains a diagram characteristic for a gelatin species used according to the present invention, wherein the viscosity (mPa.s) measured at 36° C. and pH=6 of a 10% aqueous gelatin solution is plotted against shearing rate ($s^{-1}$).

FIG. 2 contains a diagram representing the viscosity (mPa.s) in the ordinate versus the logarithm of the time (s) during which an aqueous gelatin solution containing gelatin having the viscosity-shearing rate characteristic defined in FIG. 1 was subjected to cooling according to a Test S described herein.

DETAILED DESCRIPTION OF THE INVENTION

Figure 1:
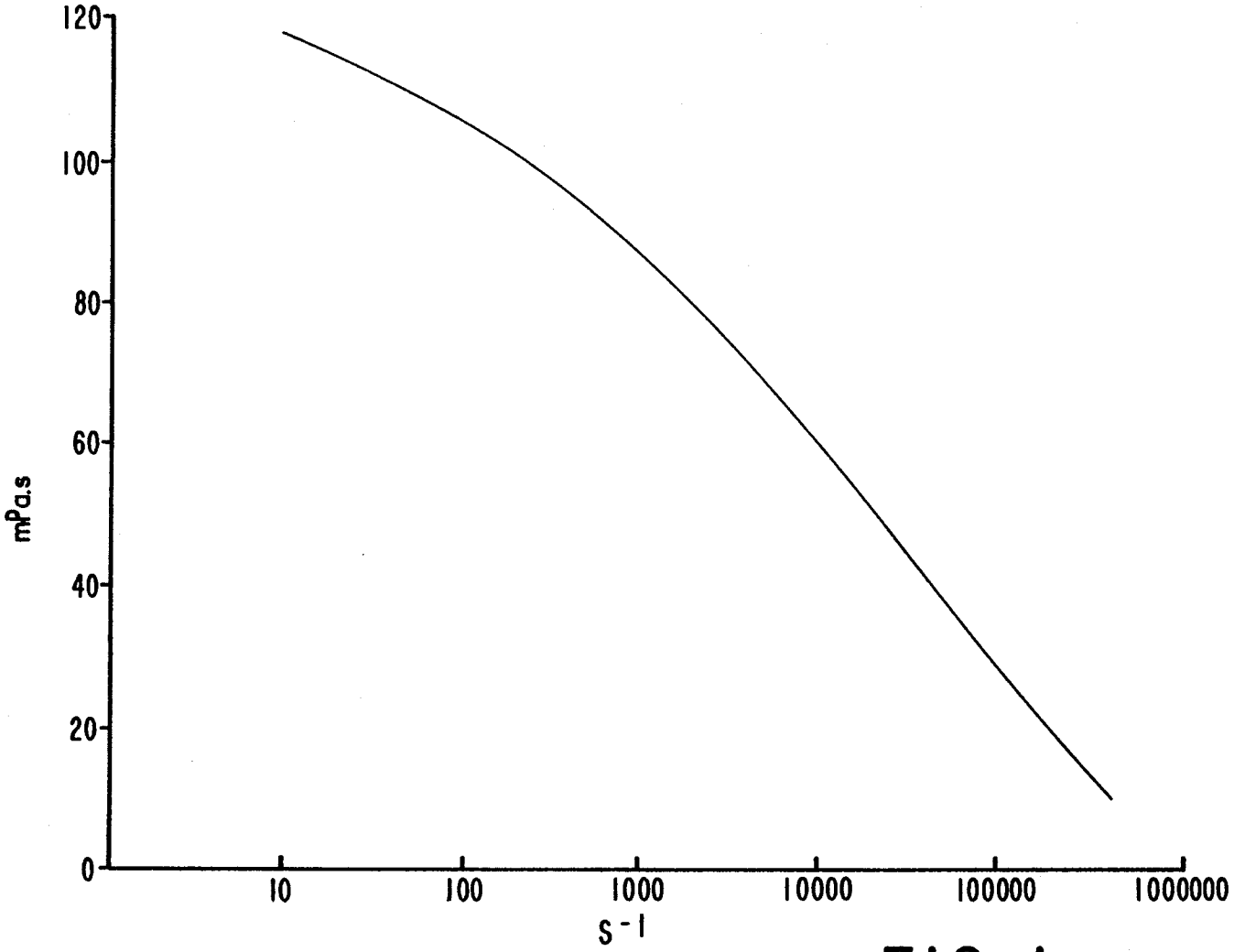

As employed herein, viscosity values in mPa.s measured at differing shearing rate refer to viscosities measured at 36° C. and pH=6 of 10 % by weight aqueous gelatin solutions using a viscosimeter operating with a rotating cylinder and marketed under the tradename HAAKE ROTOVISCO rheometer Type M 10, wherein the cylinder can be rotated at 1000 rpm and a maximal shearing rate of 44,500 $s^{-1}$.

The solidification time of gelatin used according to the present invention is preferably less than 15 s and the solidification rate is such that after 30 seconds of solidification the viscosity is not lower than 500 mPa.s, and more preferably not lower than 1000 mPa.s, measured under the test conditions of Test S described herein.

In said Test S the consistency of a 3 % wt solution of said gelatin in water at pH=6 is measured at a shearing rate of 208 $s^{-1}$ after cooling said solution for 30 seconds under the described test conditions.

| Test S |
|---|
| Applied Apparatus |
| FERRANTI SHIRLEY viscosimeter, |
| Temperature corrected pH meter, callibrated at pH 6, |
| Millivolt meter, |
| Chronometer, and |
| Thermostatic bath. |
| Reagents |
| 0.5 molar aqueous NaOH solution, |
| Distilled water. |
| Procedure |
| - Prepare 100 ml of a 3% (weight/volume) gelatin solution in water by 30 min swelling at 20° C. without stirring and dissolving the gelatin for 60 min at 40° C. with stirring. |
| - Adjust the pH to 6.00 by the required amount of said NaOH solution, keeping the sample at 40° C. |
| - The syringe for taking a sample of the obtained gelatin solution shall be flushed abundantly with warm water and thereupon with said gelatin solution. |
| - Open the viscosimeter, bring 0.75 ml of the gelatin solution on the cold plate inside, close the viscosimeter and start registration. |
| - Monitor the shearing stress and the temperature for 5 min. |
| - Open the viscosimeter slowly, set gear to neutral, rinse cone and plate thoroughly for next measurement. |
| The applied measurement parameters in using the viscosimeter are: |
| - 10 rotations/min of the cone, |
| - temperature of plate: 5° C., of body: 25° C. |
| - cone: radius: 20 mm, |
| angle: 0 17' 10". |
| -shearing rate: 208 $s^{-1}$. |

Data Registration

Plot in the ordinate the shearing stress or viscosity parameter expressed in mPa.s versus the log of the time (s) in the abscissa. The slope of the curve corresponds to the solidification rate (differential quotient). The intercept on the abscissa is the solidification time in seconds (s).

The gelatin used in the present manufacturing process of recording materials, e.g photographic silver halide emulsion materials can be prepared advantageously starting from a so-called lime-treated collagen-containing pig skin, bone or cattle hide material.

The preparation of gelatin suited for producing high viscosity aqueous solutions and rapid solidification is described in published European Patent Application (EP-A) 0 025 494.

Typical components of gelatin are microgels (molecular weight $4.5\times10^5-10^8$). oligomers of a-gelatin (molecular weight $1.2\times10^5-4.5\times10^5$), $\alpha$-gelatin (molecular weight $9.5\times10^4$) and fraction of the $\alpha$-gelatin (peptide) (molecular weight $10^{49}\times10^4$).

In the gelatin species for use according to the present invention the microgel content is preferably at least 20 % wt, the content of $\alpha$-gelatin preferably in the range of 40 to 25 % wt and the peptide content smaller than 15% by weight.

The determination of the molecular mass distribution of gelatin used according to the present invention is described by B. H. Tavernier in Proceedings of the Fifth IAG Conference held at Fribourg, September, 1988 (Reports 1988 titled Photographic Gelatin Edited by HANS Ammann-Brass and Jacques Pouradier—-Fribourg 1989) referring to Fast Protein Liquid Chromatography (FPLC).

A gelatin providing under the above defined test circumstances a viscosity of at least 35 mPa.s at a shearing rate of 1000 $s^{-1}$ and a decrease of viscosity of at least 10 mPa.s when subjected to a shearing rate of 40,000 $s^{-1}$ has been found to contain for at least 17 % by weight molecule fractions having a molecular weight of at least 450,000.

The calcium content of the gelatin used according to the present invention is not very critical, it is e.g. in the range of 0.5 to zero % by weight calculated on the gelatin.

It is known, e.g. from the book "Photographic Emulsion Chemistry" by G. F. Duffin, The Focal Press London, (1966), p. 40, that the viscosity of a gelatin solution is highly dependent on pH and is at minimum at the isoelectric point. A gelatin preferably used according to the present invention has an isoelectric point below 6.

The aqueous composition according to the present invention and layer coated therefrom may contain the above defined gelatin for use according to the present invention mixed with other types of gelatin and/or synthetic, semi-synthetic, or natural polymers that are in dissolved or dispersed form and represent at most 10 % by weight of said gelatin.

Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

Examples of polymer latex that can be used in conjunction with gelatin in silver halide emulsion layers are described in EP 0 383 283, e.g. metyl or ethyl methacrylate.

Optionally the additional binder should dispose of functional groups which allow reaction with an appropriate hardening agent in order to provide a sufficiently mechanically resistant layer. Such functional groups are especially the amino groups, but also carboxylic groups, hydroxy groups, and active methylene groups.

In the aqueous coating composition according to the present invention a hardening agent for gelatin is present in an amount sufficient to make the gelatin insoluble in aqueous photographic processing liquids once setted and dehydrated. In the production of photographic gelatin-silver halide emulsion materials on the basis of (a) mainly gelatin containing layer(s) the hardening agent(s) make that a coated and dried layer produced from said composition obtains sufficient mechanical strength to withstand treatment conditions applied in the processing of photographic gelatin-silver halide emulsion materials.

The hardener for use in a gelatin containing coating composition according to the present invention is subject to no restriction with respect to the type of hardener. Examples of suitable gelatin hardeners are described in the book "The Theory of the Photographic Process", 4th ed. by of T. H. James, Macmillan Publishing Co., Inc. New York (1977) p. 78-84. Aldehyde hardeners such as formaldehyde, glyoxal and glutaraldehyde are particularly useful. Other very suitable hardening agents are s-triazines, e.g. 2,4-dichloro-6-hydroxy-s-triazine in the form of a water soluble sodium salt and active olefins, e.g. bis(vinylsulphonyl) compounds. The hardening agents may be used in the presence of hardening accelerators, e.g. 1,3-dihydroxybenzenes also described in the above defined book of T. H. James, p. 84.

Other types of hardening agents known as quick acting hardeners for gelatin are e.g. carbamoylpyridinium salts described in U.S. Pat. No. 4,987,063 and the phosphor containing quick hardening agents described in published European paten application (EP-A) 0 408 143.

The gelatin having the above defined shear rate dependent viscosity is used advantageously in the production of all kinds of recording materials, photosensitive and non-photosensitive, but is particularly useful in the production of photographic gelatin type silver halide emulsion layer materials.

In said photographic material said gelatin may be applied in anti-halation layer(s), filter layer(s), subbing layer(s), interlayer(s), a backing layer, a protective covering layer, so-called antistress layer, and the silver halide emulsion layer(s).

The coating of the aqueous gelatin containing composition according to the present invention may proceed by any technique known in the art for the coating of aqueous coating compositions, e.g. by air knife coating, meniscus coating, doctor blade coating, roll coating, wire bar coating, dip coating, slide hopper coating and curtain coating.

The coating on a moving web of several different aqueous coating compositions proceeds preferably simultaneously as a multiple layer assemblage by means of a multilayer bead coating apparatus, preferably slide hopper coater or curtain coater, wherein the shear rate dependent viscosity of the gelatin as defined above is in favour of a particular good coating stability.

In a preferred embodiment the above defined gelatin is used in coating compositions for the production of silver halide emulsion layers. In silver halide emulsion layers produced with coating compositions containing the above defined gelatin as dispersing agent and binder for silver halide grains the coverage of silver halide expressed in the form of an equivalent amount of silver nitrate per $m^2$ may vary widely and is e.g. in the range of 2 to 10 $g/m^2$.

In film type photographic materials, i.e. materials wherein the support is transparent the silver halide coverage expressed as an equivalent amount of silver nitrate per m is e.g. in the range of 4 to 7 g per $m^2$, whereas for silver halide emulsion materials having an opaque support, e.g. polyethylene coated paper support, e.g. a silver halide coverage equivalent with a silver nitrate coverage of 1 to 4 g per $m^2$ is applied.

The gelatin defined for use according to the present invention is used advantageously in the coating of so-called low GESI silver halide emulsion layers, wherein by GESI is meant the weight ratio of gelatin to silver halide expressed as equivalent amount of silver nitrate.

In low GESI gelatin silver halide emulsion layers that ratio is considered to be not higher than 0.4, preferably lower than 0.25 and may be down to 0.05.

Silver halide emulsion coatings having a GESI higher than 0.25 are coated with good stability by means of a slide hopper coater. For coating silver halide emulsion layers with GESI lower than 0.25 a curtain coater is used preferably.

By the presence of considerably less gelatin in low GESI silver halide emulsion layers much thinner layers can be coated having less tendency to swell and having shorter solidification and drying times. Thinner layers having a higher silver halide concentration provide a shorter way to processing solution ingredients for their interaction with the silver halide grains than is the case with silver halide emulsion layers rich in gelatin and are therefor particularly useful in ultra rapid access processing.

Commonly used developers for rapid access development are on the basis of hydroquinone as main developing agent and a relatively high content of 1-phenyl-3-pyrazolidinone or N-methyl-p-aminophenol auxiliary developing agent in the presence of a fairly large free sulphite ion content.

The developing liquids containing an auxiliary developing agent as defined are more stable with respect to oxygen of the air than lith type developers containing hydroquinone as the sole developing agent and only a small amount of free sulphite. An alternative for lith-type developers on the basis of the presence of hydrazine type compounds in combination with hydroquinone type compounds and auxiliary developing agents is described e.g. in U.S. Pat. No. 4,650,746.

"Rapid-access" developers can be used in combination with any type of silver halide emulsion and are not restricted to be used in combination with so-called "lith silver halide emulsion materials" (ref. e.g. U.S. Pat. No. 4,756,990) wherein the silver halide comprises at least 50 mole % of chloride, the balance, if any, being bromide and optionally a minor amount of iodide.

Suitable contrasty working developers with good stability and that can be used in combination with silver bromide type emulsions are described e.g. in U.S. Pat. No. 4,710,451.

The production of silver halide emulsion layers with relatively high silver halide packing density due to the presence of less binding agent than is commonly encountered is further in favour of the production of images with high "covering power" (CP). By "covering power" is understood the ratio of diffuse optical density (D) to the number of grams of developed silver per $dm^2$. Silver halide emulsion layers offering a high covering power can be coated at smaller silver halide coverage which makes the production of silver halide photographic materials less expensive because therein the silver content is a dominating economic feature.

Another important advantage of photographic silver halide emulsion materials containing said gelatin defined for use according to the present invention at a GEZI ratio not higher than 0.40 is the property to yield particularly contrasty images. Such is proved by a raise in maximum gradient by lowering the GESI in combination with lith-development described by Mora C. under the title : "The Lith process" in J. Inf. Rec. Mater. 15 (1987) 1. p. 20–21. Lith-development yields silver images with high maximum gradient or gamma infinity (e.g. above 8) which is desirable in the reproduction of line work and halftone images.

For use in combination with the above defined gelatin species the halide composition of the silver halide emulsion layers is not restricted and may be any composition selected from i.a. silver chloride, silver bromide, silver iodide, silver chlorobromide, silver bromoiodide, and silver chlorobromoiodide. However, for obtaining the highest gamma infinity results the content of silver chloride is preferably at least 80 mol %. Iodide is preferably present less than 5 mol%, more preferably present less than 3 mol%.

The photosensitive silver halide can be prepared by mixing the halide and silver solutions in partially or fully controlled conditions of temperature, concentrations, sequence of addition, and rates of addition. The silver halide can be precipitated according to the single-jet method, the double-jet method, or the conversion method in the presence of gelatin as defined for use according to the present invention.

The silver halide particles of the photographic emulsions used according to the present invention may have a regular crystalline form such as a cubic or octahedral form or they may have a transition form. They may also have an irregular crystalline form such as a spherical form or a tabular form, or may otherwise have a composite crystal form comprising a mixture of said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The size distribution of the silver halide particles of the photographic emulsions to be used according to the present invention can be homodisperse or heterodisperse. A homodisperse size distribution is obtained when 95% of the grains have a size that does not deviate more than 30% from the average grain size. The average grain size of the silver halide may vary according to the requirements for image resolution and speed and is e.g. less than 100 nm, but is normally in the range of 0.1 to 3 micron.

In addition to silver halide the emulsions may also comprise organic silver salts such as e.g. silver benzotriazolate and silver behenate.

The silver halide crystals can be doped with group VIII elements of the periodic Table, preferably with $Rh^{3+}$ and/or $Ir^{4+}$, and likewise or in addition thereto with $Cd^{2+}$, $Zn^{2+}$, $Pb^{2+}$ or mixtures thereof.

The emulsion can be desalted in the usual ways e.g. by dialysis, by flocculation and re-dispersing, or by ultrafiltration.

The light-sensitive silver halide emulsion containing gelatin as defined for use according to the present invention can be a so-called primitive emulsion, in other words an emulsion that has not been chemically sensitized. However, the light-sensitive silver halide emulsion can be chemically sensitized as described i.a. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968).

Chemical sensitization can be carried out as described in said literature by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru. Pb, Cd, Hg, Tl, Pd, Pt, or Au. One of these chemical sensitization methods or a combination thereof can be used.

The light-sensitive silver halide emulsions containing gelatin for use according to the present invention can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, holopolar cyanine dyes, hemicyanine dyes, styryl dyes and hemioxonol dyes. Particularly valuable dyes are those belonging to the cyanine dyes, merocyanine dyes, complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510. cadmium salts, and azaindene compounds.

The silver halide emulsion for use in accordance with the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazolinethione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75–39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are metal salts such as e.g. mercury or cadmium salts and the compounds described in Research Disclosure N° 17643 (1978), Chapter VI.

The fog-inhibiting agents or stabilizers can be added to the silver halide emulsion prior to, during, or after the ripening thereof and mixtures of two or more of these compounds can be used.

The photographic element of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805-4,038,075 -4,292,400.

The photographic element of the present invention may further comprise various other additives such as e.g. compounds improving the dimensional stability of the photographic element, UV-absorbers, spacing agents and plasticizers.

Suitable additives for improving the dimensional stability of the photographic element are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins , and styrenes, or copolymers of the above with acrylic acids, methacrylic acids, Alpha-Beta-unsaturated dicarboxylic acids, hydroxyalkyl (meth)acrylates, sulphoalkyl (meth-)acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in US-A 4,045,229, and benzoxazole compounds as described in U.S. Pat. No. 3,700,455.

The photographic silver halide emulsions containing gelatin as defined for use according to the present invention can be used in various types of photographic elements such as used in so-called amateur and professional photography. For example, in photographic elements for graphic art reproduction, for negative type and direct positive type photographic elements, diffusion transfer reversal (DTR) photographic elements, and non-photosensitive image-receiving materials, in low-speed, e.g. room light insensitive photographic materials, high-speed photographic elements such as radiographic films used in combination with X-ray fluoresent intensifying screens and laser beam sensitive films sensitive e.g. to He-Ne gas laser beam or semi-conductor solid state laser beams of relatively low energy. Further information on photographic silver halide emulsions, preparations, addenda, processing and systems can be found in Research Disclosure December, 1989, item 308119.

The present invention is illustrated by the following examples without however limiting it thereto. All parts, ratios and percentages are by weight unless otherwise stated.

EXAMPLES 1 and 2

Figure 2:
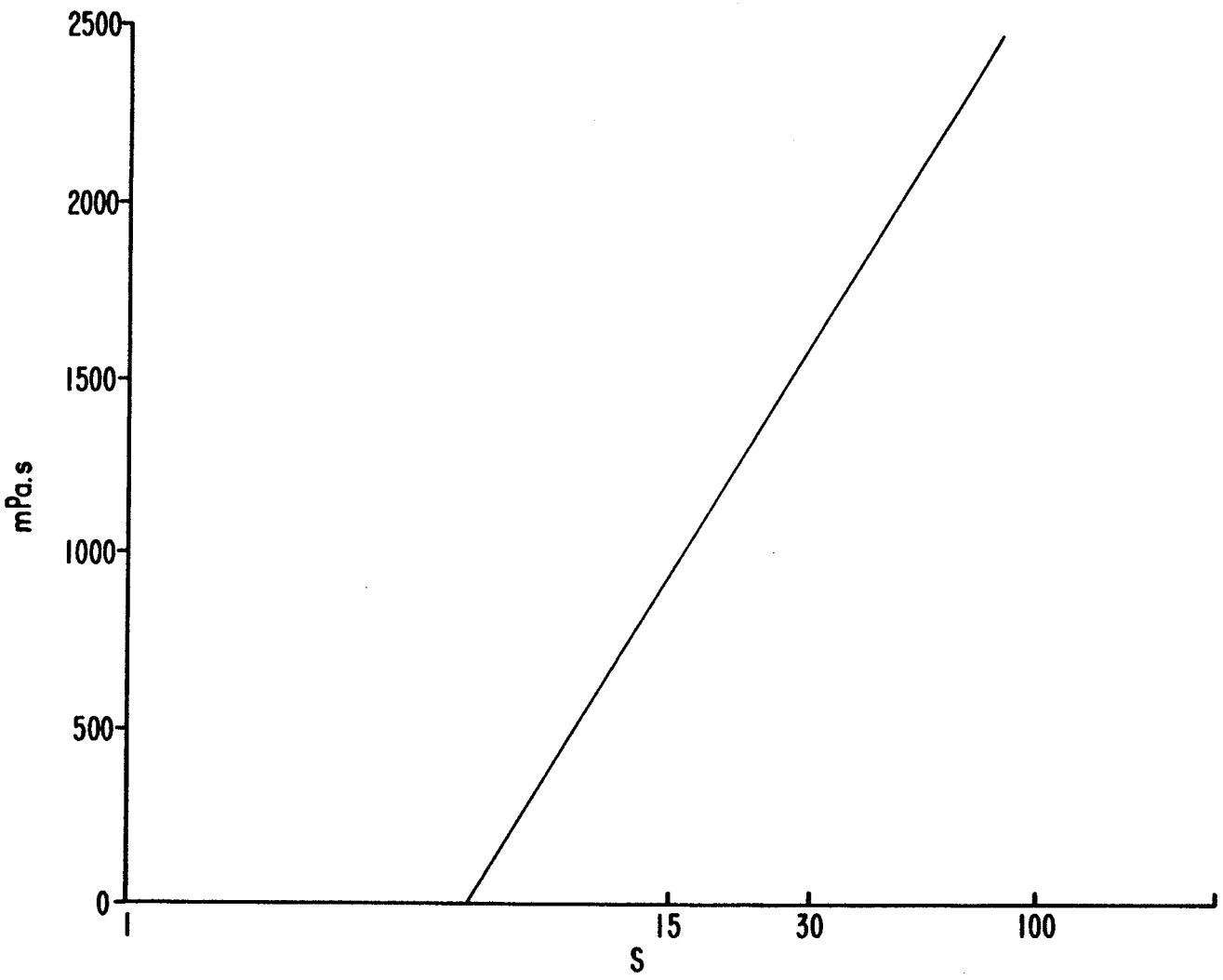

The gelatin having a shear rate dependent viscosity as characterized by curve 1 in FIG. 1 and solidification time as illustrated in FIG. 2 is used in the preparation of a silver halide emulsion, being a sulphur- and gold-sensitized silver halide emulsion comprising 83.6 mol% of silver chloride, 16 mol% of silver bromide and 0.4 mol% of silver iodide. The average grain diameter of the silver halide was 0.30 μm.

One kg of emulsion contained 1.3 mol of silver halide. The emulsion was divided in two parts, one part P (Example 1) wherein the gelatin to silver nitrate ratio, the GESI as defined above, was 0.5 and the other part 0 (Example 2) wherein the GESI was 0.12.

Next, 1.16 g of 4-hydroxy-6-methyl-1,3,3*a*,7-tetraazaindene and 7 ml of a 1.3% aqueous solution of sodium isotetradecyl sulphate were added in the order given per kg of each of said emulsion parts.

To the gelatin-containing coating composition formaldehyde was added as hardening agent in an amount of 0.2 g per g of gelatin.

The emulsion parts P and Q were coated with cascade coater at a temperature of 20° C. They were coated each on a subbed polyethylene terephthalate support at a silver halide coverage equivalent with 7.2 g of silver nitrate per $m^2$ and dried under the same conditions.

The water absorption capacity of each of the obtained photographic materials P and Q was determined by a test wherein each of the materials was soaked for 30 seconds in distilled water at 20° C. and after removing the adhering water by squeegee rollers the amount of absorbed water was measured by comparing the weight of the materials before and after said soaking.

In the photographic material P the amount of absorbed water corresponded with 8.5 per $m^2$, whereas the amount of water absorbed in photographic material Q was only 5.5 g per $m^2$. The lower GESI material of Example 2 allows the application of shorter drying times than the material of Example 1 and is therefore favoured for rapid access processing.

We claim:

1. A method for the manufacture of a recording material containing a coated and dried gelatin containing layer on a support, wherein said layer is coated by applying onto said support an aqueous coating composition containing:

(1) hydrophilic colloid matter consisting of at least 90% by weight of gelatin, (2) not more than 5% by weight with respect to the total gelatin content of said composition of a thickening agent increasing the viscosity of said composition, and (3) a hardening agent for gelatin that reduces its water-solubility after coating, characterized in that said gelatin is a gelatin species which as a 10% by weight aqueous solution at 36° C. and pH 6 has a viscosity of at least 35 Mpa.s at a shear rate of 1000 $s^{-1}$ and shows a decrease in viscosity by at least 10 Mpa.s at a shear rate of 40,000 $s^{-1}$, and as a 3% by weight aqueous solution at Ph 6 and after cooling for 30 seconds at a shearing rate of 208 $s^{-1}$ has a solidification time of less than 20 seconds and a consistency characteristic corresponding with a viscosity of more than 500 Mpa.s determined under the test conditions of Test S described in the specification.

2. Method according to claim 1, wherein said solidification time of said gelatin species is less than 15 s and said solidification rate is such that after 30 seconds of solidification the viscosity is not lower than 500 mPa.s, measured under the test conditions of said Test S.

3. Method according to claim 1, wherein said gelatin species has an isoelectric point below 6.

4. Method according to claim 1, wherein in said aqueous coating composition said gelatin species is mixed with other types of gelatin and/or synthetic, semi-synthetic, or natural polymers that are in dissolved or dispersed form and represent at most 10% by weight of said gelatin species.

5. Method according to claim 1, wherein said aqueous coating composition contains an aldehyde type gelatin hardening agent, a s-triazine gelatin hardening agent of a bis(vinylsulphonyl) gelatin hardening agent.

6. Method according to claim 1, wherein said aqueous coating composition contains dispersed silver halide and is coated to form a photosensitive silver halide emulsion layer.

7. Method according to claim 6, wherein in said silver halide emulsion layer the weight ratio of gelatin to silver halide expressed as equivalent amount of silver nitrate is lower than 0.25.

8. Method according to claim 1, wherein said layer forms an anti-halation layer, a filter layer, a subbing layer, an interlayer, a backing layer or a protective covering layer of a photographic silver halide emulsion layer material.

9. Method according to claim 1, wherein said aqueous coating composition is applied on a web type film or paper support by slide hopper coating or curtain coating.

10. Method according to claim 1, wherein said gelatin has a microgel content of at least 20% by weight, the content of α-gelatin species being in the range of 40 to 25% by weight and the peptide content being smaller than 15 % by weight, said gelatin species containing for at least 17% by weight molecule fractions having a molecular weight of at least 450,000.

* * * * *